US006769500B2

(12) United States Patent
Miglierini

(10) Patent No.: US 6,769,500 B2
(45) Date of Patent: Aug. 3, 2004

(54) OPTIMIZED EARTH BORING SEAL MEANS

(75) Inventor: Raul A. Miglierini, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 79 days.

(21) Appl. No.: 10/234,960

(22) Filed: Sep. 3, 2002

(65) Prior Publication Data

US 2003/0051921 A1 Mar. 20, 2003

Related U.S. Application Data

(60) Provisional application No. 60/316,407, filed on Aug. 31, 2001.

(51) Int. Cl.[7] ..... E21B 10/22

(52) U.S. Cl. ..... 175/371; 175/359; 175/372; 277/558; 277/559

(58) Field of Search ..... 175/359, 371, 175/372; 277/558, 544, 556, 500

(56) References Cited

U.S. PATENT DOCUMENTS

| | | | | |
|---|---|---|---|---|
| 4,151,999 A | | 5/1979 | Ringel et al. | |
| 4,336,946 A | | 6/1982 | Wheeler | |
| 4,554,985 A | | 11/1985 | Bëcklund | |
| 4,610,319 A | * | 9/1986 | Kalsi | 175/371 |
| 4,776,599 A | | 10/1988 | Vezirian | |
| 5,009,519 A | | 4/1991 | Tatum | |
| 5,655,611 A | | 8/1997 | Dolezal et al. | |

* cited by examiner

*Primary Examiner*—David Bagnell
*Assistant Examiner*—Giovanna M Collins
(74) *Attorney, Agent, or Firm*—Robert Groover

(57) ABSTRACT

A rock bit seal in which the shape of the retainer lip (which restrains the seal from axial motion in response to pressure differentials) is optimized, with respect to the as-deformed shape of the seal in place, to achieve a preload stress which is everywhere nonzero. Preferably the ratio of maximum to minimum stress in the as-installed condition is kept to a small ratio, e.g. less than 2:1.

24 Claims, 6 Drawing Sheets

NORMAL CONDITIONS AT PRV RELIEF PRESSURE

NORMAL AT LESS THAN PRV RELIEF PRESSURE

NORMAL CONDITIONS AT PRV RELIEF PRESSURE

ABNORMAL: PRV NOT RELEASING PRESSURE

ABNORMAL: COMPENSATION SYSTEM NOT WORKING

OPTIMIZED EARTH BORING SEAL MEANS

CROSS-REFERENCE TO OTHER APPLICATION

This application claims priority from provisional No. 60/316,407 filed Aug. 31, 2001, which is hereby incorporated by reference.

BACKGROUND AND SUMMARY OF THE INVENTION

The present invention relates to earth-penetrating drill bits, and particularly to sealing structures in so-called roller-cone bits.

Background: Rotary Drilling

Oil wells and gas wells are drilled by a process of rotary drilling, using a drill rig such as is shown in FIG. 3. In conventional vertical drilling, a drill bit 110 is mounted on the end of a drill string 112 (drill pipe plus drill collars), which may be several miles long, while at the surface a rotary drive (not shown) turns the drill string, including the bit at the bottom of the hole.

Two main types of drill bits are in use, one being the roller cone bit, an example of which is seen in FIG. 2. In this bit a set of cones 116 (two are visible) having teeth or cutting inserts 118 are arranged on rugged bearings. As the drill bit rotates, the roller cones roll on the bottom of the hole. The weight-on-bit forces the downward pointing teeth of the rotating cones into the formation being drilled, applying a compressive stress which exceeds the yield stress of the formation, and thus inducing fractures. The resulting fragments are flushed away from the cutting face by a high flow of drilling fluid.

The drill string typically rotates at 150 rpm or so, and sometimes as high as 1000 rpm if a downhole motor is used, while the roller cones themselves typically rotate at a slightly higher rate. At this speed the roller cone bearings must each carry a very bumpy load which averages a few tens of thousands of pounds, with the instantaneous peak forces on the bearings several times larger than the average forces. This is a demanding task.

Background: Bearing Seals

In most applications where bearings are used, some type of seal, such as an elastomeric seal, is interposed between the bearings and the outside environment to keep lubricant around the bearings and to keep contamination out. In a rotary seal, where one surface rotates around another, some special considerations are important in the design of both the seal itself and the gland into which it is seated.

The special demands of sealing the bearings of roller cone bits are particularly difficult. The drill bit is operating in an environment where the turbulent flow of drilling fluid, which is loaded with particulates of crushed rock; is being driven by hundreds of pump horsepower. The flow of mud from the drill string may also carry entrained abrasive fines. The mechanical structure around the seal is normally designed to limit direct impingement of high-velocity fluid flows on the seal itself, but some abrasive particulates will inevitably migrate into the seal location. Moreover, the fluctuating pressures near the bottomhole surface mean that the seal in use will see forces from pressure variations which tend to move it back and forth along the sealing surfaces. Such longitudinal "working" of the seal can be disastrous in this context, since abrasive particles can thereby migrate into close contact with the seal, where they will rapidly destroy it.

Commonly-owned U.S. application Ser. No. 09/259,851, filed Mar. 1, 1999 and now issued as U.S. Pat. No. 6,279,671

(Roller Cone Bit With Improved Seal Gland Design, Panigrahi et al.), copending (through continuing application Ser. No. 09/942,270 filed Aug. 27, 2001 and hereby incorporated by reference) with the present application, described a rock bit sealing system in which the gland cross-section includes chamfers which increase the pressure on the seal whenever it moves in response to pressure differentials. This helps to keep the seal from losing its "grip" on the static surface, i.e. from beginning circumferential motion with respect to the static surface. FIG. 4 shows a sectional view of a cone according to this application; cone 116 is mounted, through rotary bearings 12, to a spindle 117 which extends from the arm 46 seen in FIG. 1. A seal 20, housed in a gland 22 which is milled out of the cone, glides along the smooth surface of spindle 117 to exclude the ambient mud 21 from the bearings 12. (Also visible in this Figure is the borehole; as the cones 116 rotate under load, they erode the rock at the cutting face 25, to thereby extend the generally-cylindrical walls 25 of the borehole being drilled.) The present application discloses a different sealing structure, in place of the seal 20 and gland 22, but FIG. 4 gives a view of the different conventional structures which the seal protects and works with.

Optimized Earth Boring Seal Means

The present application teaches a seal gland having a contour which is designed to achieve a particular stress distribution in relation to the DEFORMED seal, in its installed position. In the presently preferred embodiment, the stress distribution includes not only sealing stress areas (on both the journal and the gland sides), but also an area of distributed preload stress in substantially all of the moving area (on the "dynamic" side of the seal) which laterally retains the seal. The areas of distributed preload stress provide a mild preloading for the installed seal, so that longitudinal forces (due to differential pressure) merely produce an increased stress in these areas, without inducing motion. The peak value of this preload stress is preferably minimized, to avoid friction and/or seal erosion, and the minimum value of this stress is preferably kept above zero, to avoid in-migration of particulates.

Simulation of the seal's deformed profile is preferably used to estimate the distribution of stresses. The locations and dimensions of the sealing surfaces, of the gland, and of the seal will define an initial value for sealing stress, as well as an initial value for preload stress if any. The contour (and possibly dimensions) of the retainer lip can then be adjusted as appropriate, to achieve the distribution of preload stress described above.

The contour of the seal under load will depend on the seal's unloaded cross-section, and on the load which is applied to it by the contour of the metal elements it is interfaced to. Thus achievement of a uniform preload stress in the longitudinal retention areas actually requires solution of a variational problem, since the contour of the metal shapes and the as-deformed seal contour are both variables which must be jointly optimized to achieve the desired result.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

The present application teaches a seal gland having a contour which is designed to achieve a particular stress distribution in relation to the DEFORMED seal, in its installed position. In the presently preferred embodiment, the stress distribution includes not only sealing stress areas (on both the journal and the gland sides), but also an area of distributed preload stress in substantially all of the moving area (on the "dynamic" side of the seal) which laterally retains the seal. The areas of distributed preload stress provide a mild preloading for the installed seal, so that longitudinal forces (due to differential pressure) merely produce an increased stress in these areas, without inducing motion. The peak value of this preload stress is preferably minimized, to avoid friction and/or seal erosion, and the minimum value of this stress is preferably kept above zero, to avoid in-migration of particulates.

Simulation of the seal's deformed profile is preferably used to estimate the distribution of stresses. The locations and dimensions of the sealing surfaces, of the gland, and of the seal will define an initial value for sealing stress, as well as an initial value for preload stress if any. The contour (and possibly dimensions) of the retainer lip can then be adjusted as appropriate, to achieve the distribution of preload stress described above.

The contour of the seal under load will depend on the seal's unloaded cross-section, and on the load which is applied to it by the contour of the metal elements it is interfaced to. Thus achievement of a uniform preload stress in the longitudinal retention areas actually requires solution of a variational problem, since the contour of the metal shapes and the as-deformed seal contour are both variables which must be jointly optimized to achieve the desired result.

Figure 1A:
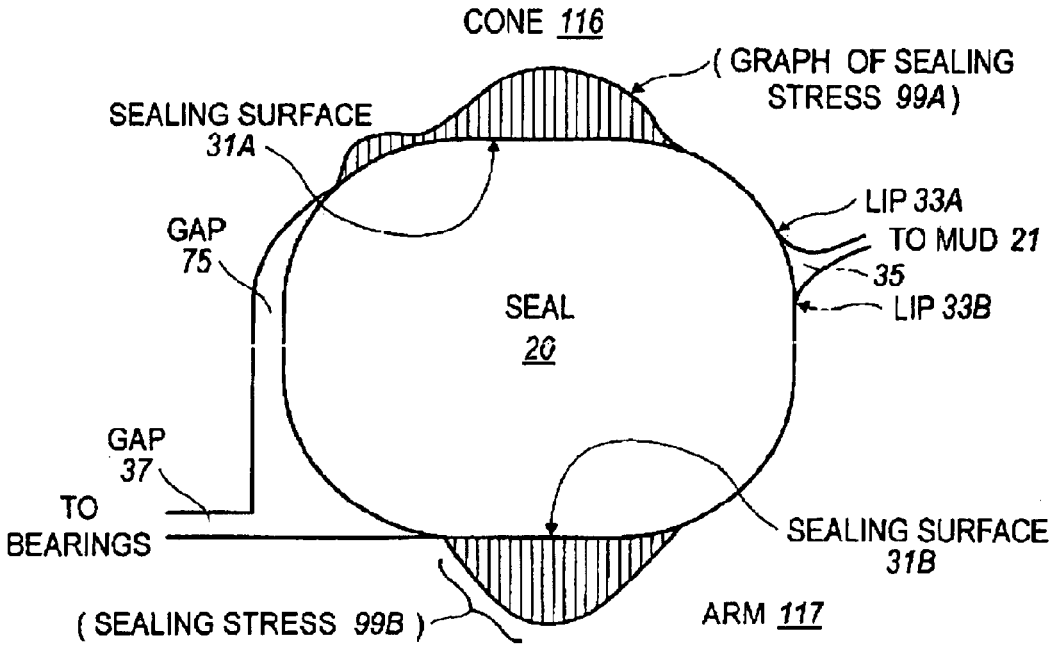
FIG. 1A shows a sample sealing structure embodiment, with an overlaid graph of the sealing stress values where the seal is compressed between the arm and the cone.
Figure 5:
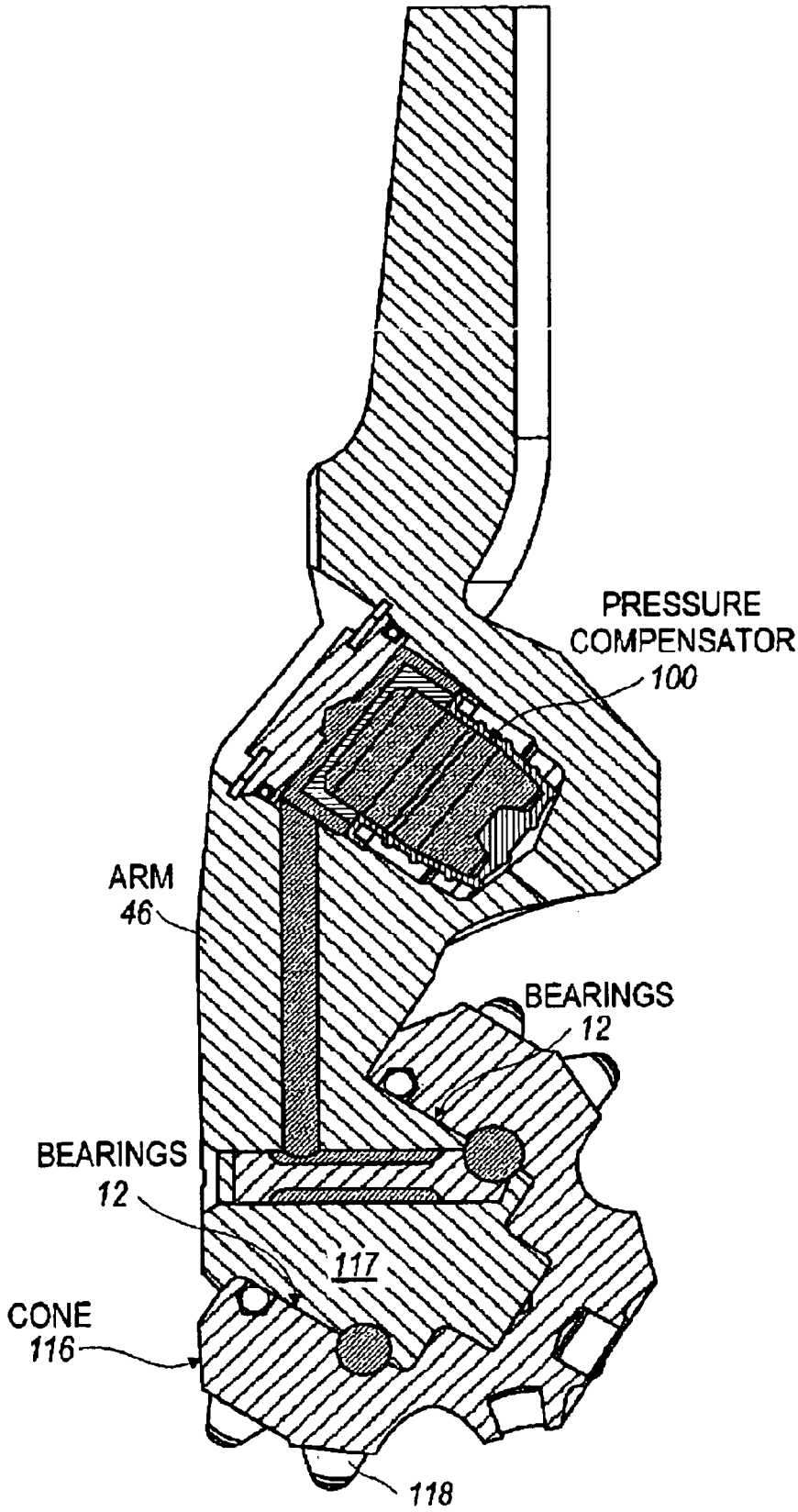
FIG. 5 shows a sectional view of a larger extent of a roller-cone-type bit's arm, including the pressure compensation system.

FIG. 1A shows a sample sealing structure embodiment, including a seal 20 interposed between sealing surfaces 31A (of the cone 116) and 31B (part of the arm 117/46). Sealing surface 31A extends up to a lip 33A, and sealing surface 31B extends up to form a lip 33B; between these two lips is a gap 35 which leads out to the mud volume 21. At the opposite side of seal 20 is another gap 37 which extends toward the bearings. The pressure compensator 100 (seen in FIG. 5) is normally precharged with grease to a positive pressure, but FIG. 1A shows stress distributions BEFORE this positive pressure is applied. This Figure shows a graph of the sealing stress which the seal 20 sees at the metal sealing surfaces 31A and 31B. Note that a gap 75 is shown on the back side of seal 20; this gap is harmless, since it is exposed only to clean lubricant, not to the ambient mud. In this sample illustrated embodiment the seal 20 is an O-ring, the two sealing surfaces are formed from the inner surface of a cone and the end of a spindle 117 (where it transitions into the arm 46), and the retainer lips 33A/33B extend only up to about the midpoint of the seal. (However, as discussed below, many variations are possible.)

Figure 1B:
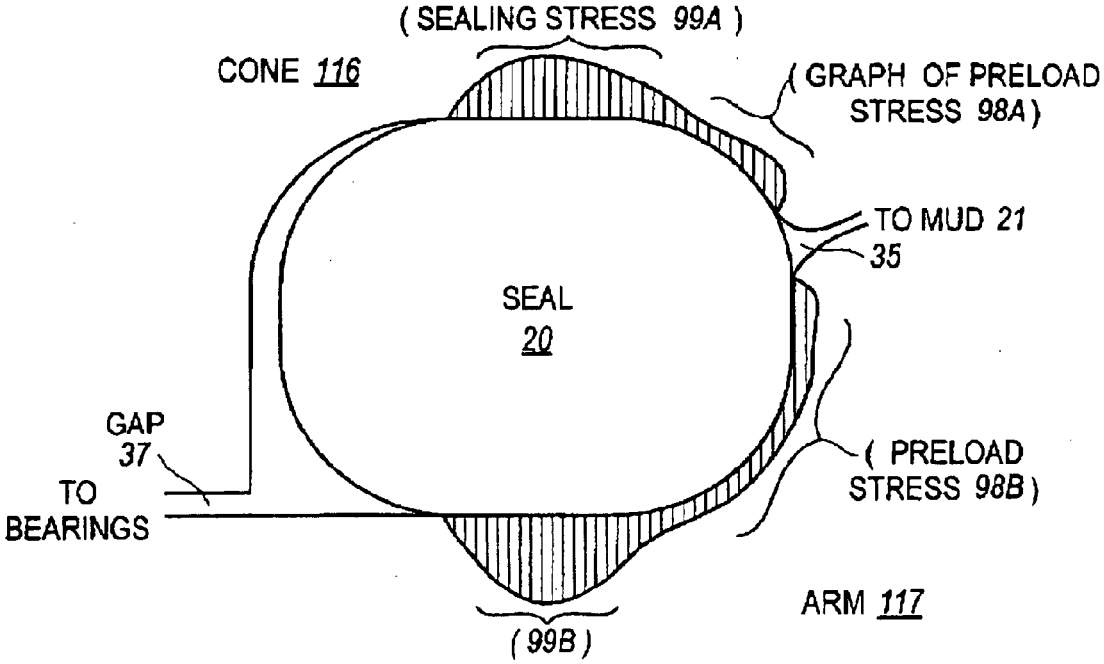
FIG. 1B shows the same structure as FIG. 1A, and also indicates the distribution of preload stress under normal positive pressure at the PRV relief pressure.

FIG. 1B shows the same structure as FIG. 1A, and also indicates the distribution of preload stress under normal positive pressure at the PRV relief pressure. (In the orientation shown, the seal is being pushed to the right, since the hydrostatic pressure in gap 37 is greater than that in gap 35.) This pressure on the seal produces preload stress distributions on lip 31A and on lip 31B; both of these stress distributions are shown graphically, as overlaid plots 98A and 98B respectively. Note particularly the distribution 98B: the distribution of preload stress on the dynamic element (the arm 117/46) has been made low and fairly uniform. This innovative teaching avoids zero-stress areas (which might lead to particulate incursion) while also keeping a low maximum stress within distribution 98B. (Note that the maximum stress within distribution 99B is much larger.) Note also that, in this example, the distribution 98B (on the dynamic surface) is more uniform than the distribution 98A (on the static surface).

Figure 1C:
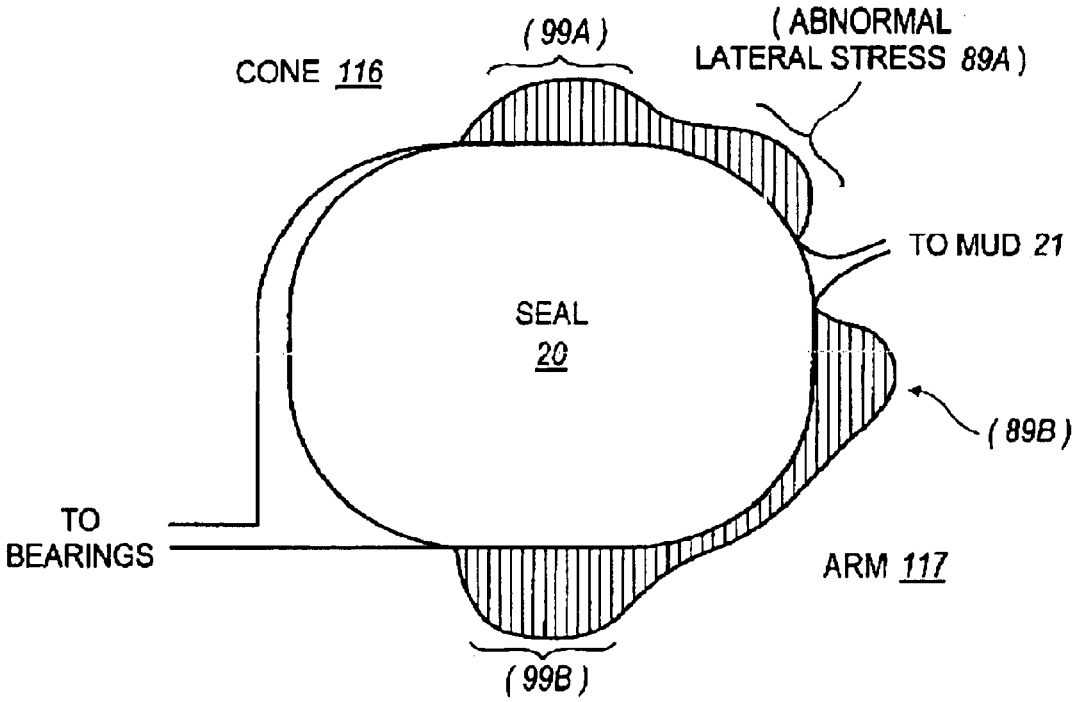
FIG. 1C shows the same structure as FIG. 1B, under the abnormal condition where the PRV has not (or not yet) limited the hydrostatic pressure across the seal to the design level.

FIG. 1C shows the same structure as FIG. 1B, under the abnormal condition where the PRV has not (or not yet) limited the hydrostatic pressure across the seal to the design level. In this case the transient larger hydrostatic pressure produces transient stress distributions 89A and 89B which are more intense than the preload distributions 98A and 98B. However, since the preload distributions 98A and 98B were already nonzero, little movement of the seal 20 occurs as pressures cycle between the conditions of FIGS. 1B and 1C.

As the seal wears, seal material will gradually be erodod in the locations of high stress on dynamic surfaces, i.e. at locations of stress distributions 99B and (if present for significant duration) 89B. However, the nonzero minimum value of preload stress 98B (under PRV-limited pressure) will help to avoid or delay the presence of any gaps where particulates can invade.

Figure 1D:
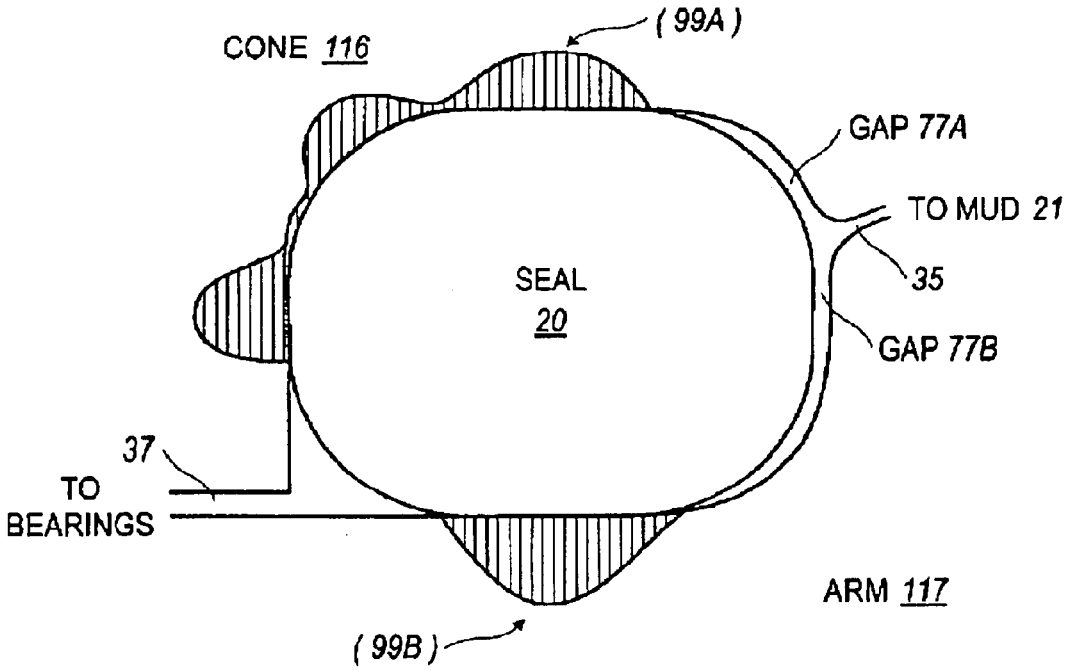
FIG. 1D shows the same structure as FIG. 1B, under the abnormal condition where the pressure compensator has failed.
Figure 2:
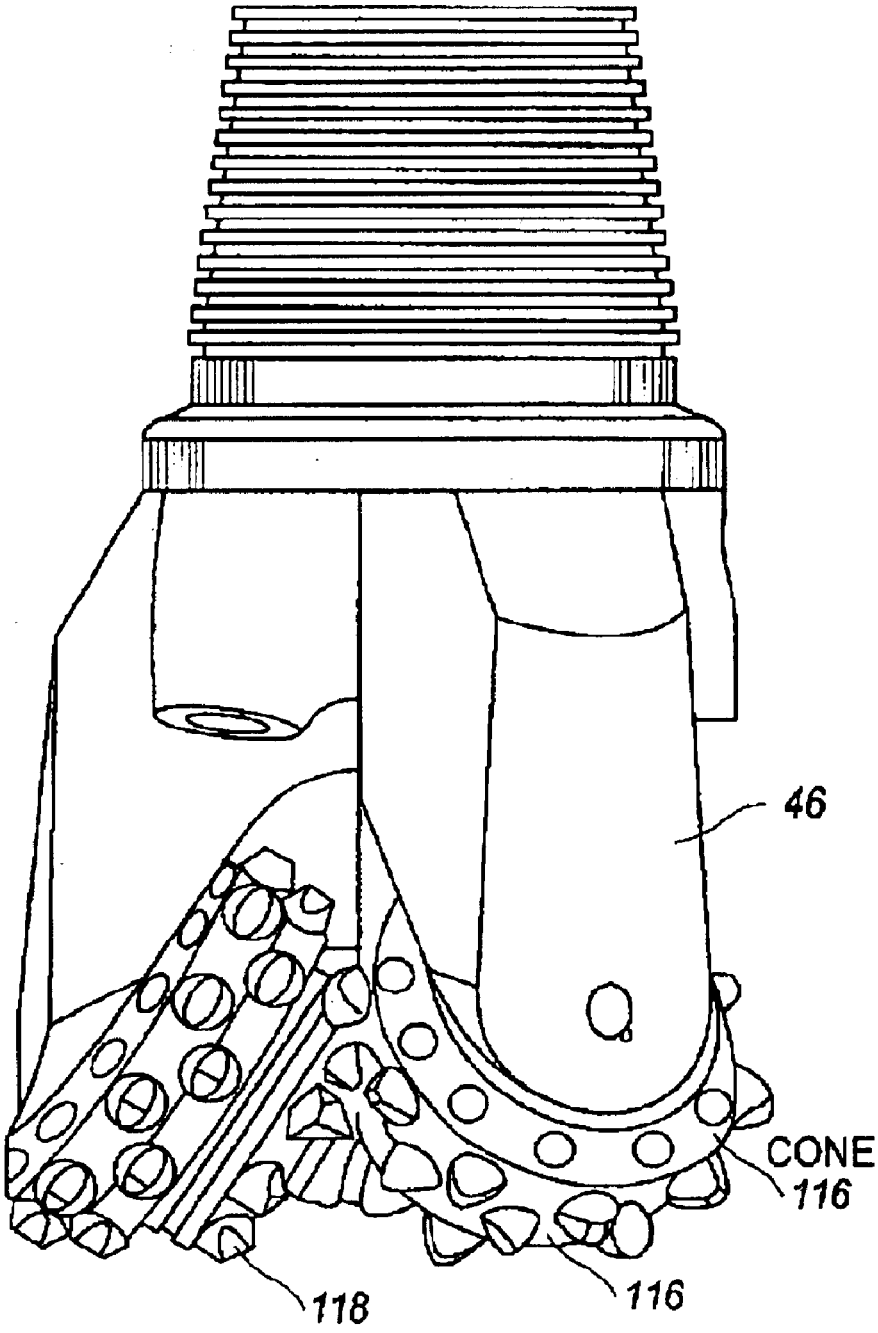
FIG. 2 shows a roller-cone-type bit.
Figure 3:
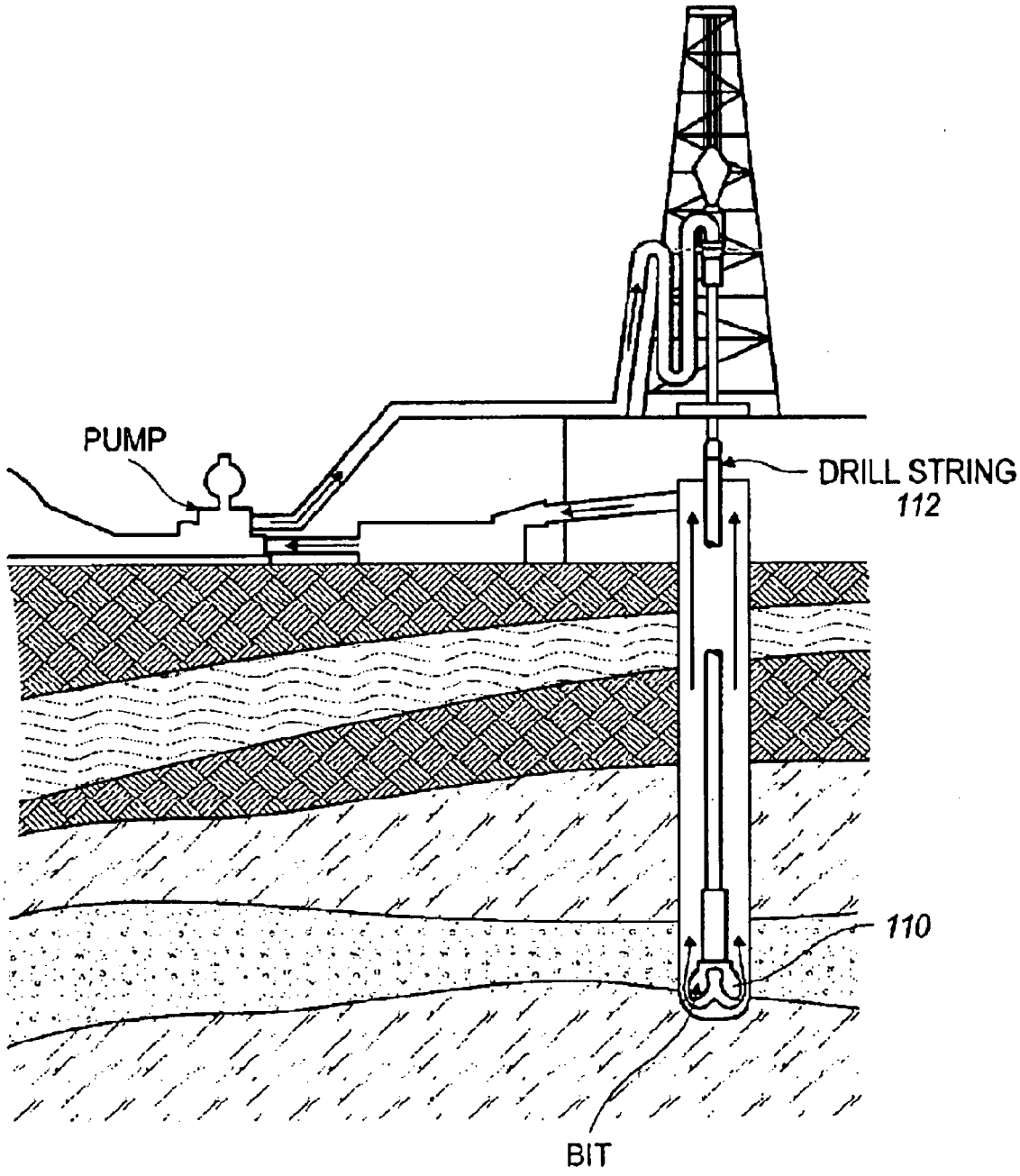
FIG. 3 shows a conventional drill rig.
Figure 4:
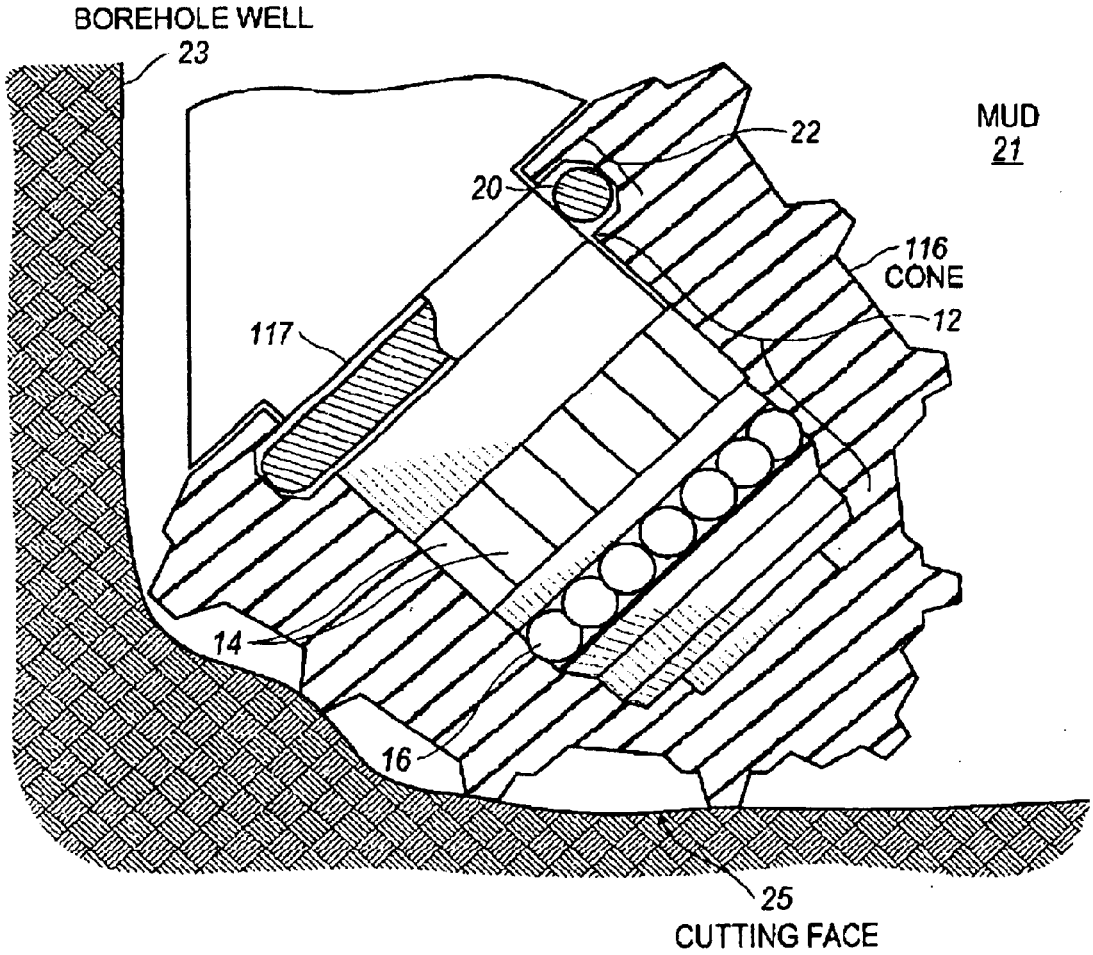
FIG. 4 shows a sectional view of a cone mounted on a spindle which extends from a bit's arm.

FIG. 1D shows the same structure as FIG. 1B, under the abnormal condition where the pressure compensator has failed. Here the pressure at gap 35 exceeds that at gap 37, and the seal 20 has shifted to open up voids 77A and 77B. Mud can now invade these voids, and rapid failure can be expected.

Achieving the desirable result of FIG. 1B is achieved, in practice, by an iterative design method where the specified metal sidewall profile 33B is adjusted to match the as-deformed contour of a given seal design. With modern manufacturing techniques almost any smooth contour can be designed into the sidewall profile, so that rapid design changes in this area are now possible. Since the available seal profiles and materials are typically constrained by the molds and processes used to manufacture them in large runs at the vendor, it is easier (at least currently) to modify the specified metal shape to fit the precise as-deformed shape of the seal material.

The as-deformed shape of the seal is preferably simulated, once the characteristics of the seal are known. Where the seal is nonuniform this may require a little care in the finite-element analysis, since the grid points themselves may have to be moved during the simulation, as incremental deformation of the seal is computed, to assure that the correct elasticity values (or more generally the correct tensor field distribution of the elasticity tensor) is applied for the next step.

For a-priori simulation of a new nonuniform seal composition, one can, for example, incrementally simulate the sequential deformation of the seal during assembly; this would also permit swelling effects and hysteretic effects to be allowed for. This is cumbersome, but provides a very general way to accommodate complex nonuniformities. Of course, for a known seal type, an initial contour for the as-deformed seal shape can be pulled from previous simulations, and then fewer iterations can be used to update it.

Note that an important component of the as-deformed seal shape is the clearance specified for the sealing surfaces. Another important component, in some cases, can be the axial spacing between the surfaces which retain the seal in its location.

The amount of preload stress on the seal can be small, but it is desirable to have a nonzero value to assure that the seal does not move axially. Thus while the preferred design objective is to achieve a low and uniform preload stress (outside of the zone of sealing stress), this is really a simplified goal: a more general statement would be to keep the minimum value of preload stress up, while keeping the maximum value of preload stress down. More quantitatively, it is preferred to keep the ratio of maximum to minimum stresses less than 2:1 over at least half of the circumferential distance between the lip of the sidewall and the point where the sealing stress is at least half its peak value.

Peak values in the preload zone are preferably kept low enough to minimize friction. (Localized excess friction can result in a dry spot where the seal has greatly increased adhesion to the dynamic (moving) surface.)

Normally the seal will experience hydraulic pressure due to the maximum pressure allowed by the PRV; this pressure provides the complementary force to the reaction force exerted by the retaining surface.

Applied hydraulic forces will produce stress maxima in the seal near the lip, and, as the seal wears in service, this area can wear to the point where it no longer provides a secondary seal against in-migration of particulates. If there were an area without preload behind the near-lip area of contact, particulates could accumulate in this area, and result in dragging the seal along and/or erosion of the seal. Thus the present application teaches that it is desirable to have preload stress along substantially the whole area of the lateral support.

According to a disclosed class of innovative embodiments, there is provided: A rock bit sealing structure assembly comprising: a spindle exterior surface and a cone interior surface defining seal compression surfaces therebetween; a seal positioned between said seal compression surfaces, and deformed under stress from said surfaces, and resting statically with respect to a first one of said surface while moving dynamically with respect to a second one of said surfaces; and an extension of said second surface which confines said seal from motion along said second surface; said extension having a profile which is complementary to the profile of said seal as deformed, and which provides a nonzero distributed preload stress to all portions of said seal in contact therewith, when standard lubricant filling hydrostatic pressure is applied thereto; whereby said seal is constrained by said extension against moving in response to hydraulic pressure differentials, but is not dragged along by friction with said extension during normal operation.

According to another disclosed class of innovative embodiments, there is provided: A sealing structure, comprising: a spindle exterior surface and a cone interior surface defining seal compression surfaces therebetween; a seal positioned between said compression surfaces, and deformed under stress from said surfaces, and resting statically with respect to a first one of said surface while moving dynamically with respect to a second one of said surfaces; and an extension of said second surface which confines said seal from motion along said second surface; said extension having a profile which is complementary to the profile of said seal as deformed, and which provides a distributed preload stress to portions of said seal in contact therewith; whereby said seal is constrained by said extension against moving in response to hydraulic pressure differentials, but is not dragged along by friction with said extension during normal operation.

According to another disclosed class of innovative embodiments, there is provided: A rotary sealing structure, comprising: a seal positioned between and deformed under sealing stress from first and second seal compression surface, and resting statically with respect to said first surface while moving dynamically with respect to said second surface; and an extension of said second surface which confines said seal from motion along said second surface; said extension having a profile which is complementary to the profile of said seal as deformed, and which provides a distributed preload stress to portions of said seal in contact therewith, said preload stress having a maximum intensity, outside the location of said sealing stress, which is less than half the peak value of said sealing stress, and having a minimum intensity which is more than one-third of said maximum intensity; whereby said seal is constrained by said extension against moving axially in response to hydrostatic pressure.

According to another disclosed class of innovative embodiments, there is provided: A method of designing a bit for rotary drilling, comprising the actions of: simulating the as-deformed shape of a seal element under a sealing stress between a static and a dynamic sealing surface; and optimizing the contour of an extension of said dynamic sealing surface to provide a distributed preload stress, under an applied hydrostatic preload pressure, which is everywhere nonzero but less than said sealing stress.

Modifications and Variations

As will be recognized by those skilled in the art, the innovative concepts described in the present application can be modified and varied over a tremendous range of applications, and accordingly the scope of patented subject matter is not limited by any of the specific exemplary teachings given. Some contemplated modifications and variations are listed below, but this brief list does not imply that any other embodiments or modifications are or are not foreseen or foreseeable.

The disclosed inventions are also applicable to seals which have nonuniform elasticity, and indeed can be particularly advantageous in such cases. The commonest technique for achieving nonuniform seal elasticity is to combine a harder elastomer with a softer elastomer, but other techniques are also possible; for example thermal differentials can be applied during molding of the seal, or a coating can be applied to harden one surface, or irradiation can be used to harden one surface.

In one contemplated embodiment, more than one seal is using. In this case the disclosed inventions would be most applicable to the seal which experiences the greater dynamic pressure variation.

In one contemplated but less preferred alternative embodiment, the arm is the static surface and the cone provides the dynamic surface.

Note that the preload stress is opposed by the hydrostatic force exerted on the seal by the grease at its initial preload pressure (i.e. at the maximum pressure permitted by the pressure relief valve). As the drill bit goes downhole (and its temperature rises), the relief valve should keep the pressure at this same maximum value. However, if a bit is tripped uphole early in its lifetime, it is also possible to refill the compensator reservoir, to again provide the hydrostatic pressure for correct preloading.

The preferred design method treats the seal characteristics as input data, and optimizes the metal contours to achieve the described objectives. However, where the economics of seal design and manufacturing techniques permit easy alteration of the seal, it is also possible to treat the seal's dimensions and characteristics as variables, again aiming at a match between the as-deformed shape for the seal and the confining surface, to achieve the desired low and approximately uniform preload.

Reference has occasionally been made to the "metal" surfaces which contact the seal, but of course ceramic or organic coatings can be applied to such surfaces if desired.

In another possible modification, "filters" can be placed on one or both sides of seal. These filters are rings formed of a softer elastomer than the seal itself, ensuring that they wear less than does the seal. The filter(s) act to trap bearing wear material migrating from the bearings on one side, and/or to trap the highly abrasive drilling mud on the other side of the seal.

It is most preferable to include chamfers in the seal gland in the static surface, to assure that the seal stays in position on the static element; but alternatively various other techniques can be used to avoid a double-dynamic operation.

Precise uniformity of the preload stress is not required; the distribution of preload stress is optimized in response to the constraints just described. Note that the stress will (necessarily) vary smoothly along the boundary of the seal (since it is elastic and deformable, and the metal contour is smooth), so the sealing stress will gradually transition into the preload stress value.

When a pressure transient appears on the seal, the preload stress typically increases locally (near the edge of the retainer lip). This also implies that the uniformity of the preload stress will be somewhat dependent on the pressure value set by the pressure relief valve.

In various embodiments, various ones of the disclosed inventions can be applied not only to bits for drilling oil and gas wells, but can also be adapted to other rotary drilling applications (especially deep drilling applications, such as geothermal, geomethane, or geophysical research).

In various embodiments, various ones of the disclosed inventions can be applied not only to top-driven and table-driven configurations, but can also be applied to other rotary drilling configurations, such as motor drive.

In various embodiments, various ones of the disclosed inventions can be applied not only to drill bits per se, but also to related rock-penetrating tools, such as reamers, coring tools, etc.

In various embodiments, various embodiments of the disclosed inventions can be applied to fixed-cutter bits as well as roller-cone bits.

Additional general background on seals, which helps to show the knowledge of those skilled in the art regarding implementation optionss and the predictability of variations, can be found in the following publications, all of which are hereby incorporated by reference: Seals and Sealing Handbook (4.ed. M.Brown 1995); Leslie Horve, Shaft Seals for Dynamic Applications (1996); Issues in Seal and Bearing Design for Farm, Construction, and Industrial Machinery (SEA 1995); Mechanical Seal Practice for Improved Performance (ed. J. D. Summers-Smith 1992); The Seals Book (Cleveland, Pentagon Pub. Co. 1961); Seals Handbook (West Wickham, Morgan-Gambian, 1969); Frank L. Bouquet, Introduction to Seals and Gaskets Engineering (1988); Raymond J. Donachie, Bearings and Seals (1970); Leonard J. Martini, Practical Seal Design (1984); Ehrhard Mayer, Mechanical Seals (trans. Motor Industry Research Association, ed. B. S. Nau 1977); and Heinz K. Muller and Bernard S. Nau, Fluid Sealing Technology: Principles and Applications (1998).

Additional general background on drilling, which helps to show the knowledge of those skilled in the art regarding implementation options and the predictability of variations, may be found in the following publications, all of which are hereby incorporated by reference: Baker, A Primer of Oilwell Drilling (5.ed. 1996); Bourgoyne et al., Applied Drilling Engineering (1991); Davenport, Handbook of Drilling Practices (1984); Drilling (Australian Drilling Industry Training Committee 1997); Fundamentals of Rotary Drilling (ed. W. W. Moore 1981); Harris, Deepwater Floating Drilling Operations (1972); Maurer, Advanced Drilling Techniques (1980); Nguyen, Oil and Gas Field Development Techniques: Drilling (1996 translation of 1993 French original); Rabia, Oilwell Drilling Engineering/Principles and Practice (1985); Short, Introduction to Directional and Horiztontal Drilling (1993); Short, Prevention, Fishing & Repair (1995); Underbalanced Drilling Manual (Gas Research Institute 1997); the entire PetEx Rotary Drilling Series edited by Charles Kirkley, especially the volumes entitled Making Hole (1983), Drilling Mud (1984), and The Bit (by Kate Van Dyke, 4.ed. 1995); the SPE reprint volumes entitled "Drilling," "Horizontal Drilling," and "Coiled-Tubing Technology"; and the Proceedings of the annual LADC/SPE Drilling Conferences from 1990 to date; all of which are hereby incorporated by reference.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A rock bit sealing structure assembly comprising:

a spindle exterior surface and a cone interior surface defining seal compression surfaces therebetween;

a seal positioned between said seal compression surfaces, and deformed under stress from said surfaces, and resting statically with respect to a first one of said surfaces while moving dynamically with respect to a second one of said surfaces; and an extension of said second surface which confines said seal from motion along said second surface;

said extension having a profile which is complementary to the profile of said seal as deformed, and which provides a nonzero distributed preload stress to all portions of said seal in contact therewith, when standard lubricant-filling hydrostatic pressure is applied thereto;

whereby said seal is constrained by said extension against moving in response to hydraulic pressure differentials, but is not dragged along by friction with said extension during normal operation.

2. The sealing structure of claim 1, wherein said seal compression surfaces are substantially cylindrical.

3. The sealing structure of claim 1, wherein said seal is entirely elastomeric.

4. The sealing structure of claim 1, wherein said first surface is part of a cone, and said second surface is part of a spindle.

5. The sealing structure of claim 1, wherein said seal is homogeneous.

6. A bit for downhole rotary drilling, comprising:

a body having an internal passage for the delivery of drilling fluid, said body having an attachment portion capable of being attached to a drill string;

at least one cutting element rotatably supported, through a respective bearing, by a respective spindle which is supported by said body; and at least one seal according to claim 1 which provides a dynamic seal between said cutting element and said spindle, to thereby exclude drilling mud from said bearing.

7. A method for rotary drilling, comprising the actions of:

applying torque and weight-on-bit to a drill string having a roller-cone-type bit thereon;

allowing cones of said bit rotate on bearings which are mounted on spindles of said bit, to thereby extend a borehole; and excluding debris from said bearings by using a seal according to claim 1.

8. A rotary drilling system, comprising:

a roller-cone-type bit mounted on a drill string, and having cutter cones rotatably mounted on bearings which are supported by spindles of said bit; and machinery which applies torque and weight-on-bit to said drill string, to thereby extend a borehole;

wherein said bearings are protected by seals according to claim 1.

9. A sealing structure, comprising:

a spindle exterior surface and a cone interior surface defining seal compression surfaces therebetween;

a seal positioned between said compression surfaces, and deformed under stress from said surfaces, and resting statically with respect to a first one of said surfaces while moving dynamically with respect to a second one of said surfaces; and an extension of said second surface which confines said seal from motion along said second surface;

said extension having a profile which is complementary to the profile of said seal as deformed, and which provides a distributed preload stress to portions of said seal in contact therewith;

whereby said seal is constrained by said extension against moving in response to hydraulic pressure differentials, but is not dragged along by friction with said extension during normal operation.

10. The sealing structure of claim 9, wherein said seal compression surfaces are substantially cylindrical.

11. The sealing structure of claim 9, wherein said seal is entirely elastomeric.

12. The sealing structure of claim 9, wherein said seal is homogeneous.

13. A bit for downhole rotary drilling, comprising:

a body having an internal passage for the delivery of drilling fluid, said body having an attachment portion capable of being attached to a drill string;

at least one cutting element rotatably supported, through a respective bearing, by a respective spindle which is supported by said body; and at least one seal according to claim 9 which provides a dynamic seal between said cutting element and said spindle, to thereby exclude drilling mud from said hearing.

14. A method for rotary drilling, comprising the actions of:

applying torque and weight-on-bit to a drill string having a roller-cone-type bit thereon;

allowing cones of said bit to rotate on bearings which are mounted on spindles of said bit, to thereby extend a borehole; and excluding debris from bearings by using a seal according to claim 9.

15. A rotary drilling system, comprising:

a roller-cone-type bit mounted on a drill string, and having cutter cones rotatably mounted on bearings which are supported by spindles of said bit; and machinery which applies torque and weight-on-bit to said drill string, to thereby extend a borehole;

wherein said bearings are protected by seals according to claim 9.

16. A rotary sealing structure, comprising:

a seal positioned between and deformed under sealing stress from first and second seal compression surfaces, and resting statically with respect to said first surface while moving dynamically with respect to said second surface; and an extension of said second surface which confines said seal from motion along said second surface; said extension having a profile which is complementary to the profile of said seal as deformed, and which provides a distributed preload stress to portions of said seal in contact therewith, said preload stress having a maximum intensity, outside the location of said sealing stress, which is less than half the peak value of said sealing stress, and having a minimum intensity which is more than one-third of said maximum intensity;

whereby said seal is constrained by said extension against moving axially in response to hydrostatic pressure.

17. The sealing structure of claim 16, wherein said seal compression surfaces are substantially cylindrical.

18. The sealing structure of claim 16, wherein said seal is entirely elastomeric.

19. The sealing structure of claim 16, wherein said seal is homogeneous.

20. The sealing structure of claim 16, wherein said first surface is part of a rock bit's cone, and said second surface is part of a spindle.

21. A bit for downhole rotary drilling, comprising:

a body having an internal passage for the delivery of drilling fluid, said body having an attachment portion capable of being attached to a drill string;

at least one cutting element rotatably supported, through a respective bearing, by a respective spindle which is supported by said body; and at least one seal according to claim 16 which provides a dynamic seal between said cutting element and said spindle, to thereby exclude drilling mud from said bearing.

22. A method for rotary drilling, comprising the actions of:

applying torque and weight-on-bit to a drill string having a roller-cone-type bit thereon;

allowing cones of said bit to rotate on bearings which are mounted on spindles of said bit, to thereby extend a borehole; and excluding debris from said bearings by using a seal according to claim 16.

23. A rotary drilling system, comprising:

a roller-cone-type bit mounted on a drill string, and having cutter cones rotatably mounted on bearings which are supported by spindles of said bit; and machinery which applies torque and weight-on-bit to said drill string, to thereby extend a borehole;

wherein said bearings are protected by seals according to claim 16.

24. A method of designing a bit for rotary drilling, comprising the actions of:

simulating the as-deformed shape of a seal element under a sealing stress between a static and a dynamic sealing surface; and optimizing the contour of an extension of said dynamic sealing surface to provide a distributed preload stress, under an applied hydrostatic preload pressure, which is everywhere nonzero but less than said sealing stress.

* * * * *